United States Patent [19]

Van Gaasbeek et al.

[11] 4,223,891

[45] Sep. 23, 1980

[54] GOLF STROKE ANALYZER

[76] Inventors: Richard Van Gaasbeek, Monument Ter. Apts., #4, Hatboro, Pa. 19040; Robert W. Britton, 241 Surrey Rd., Warminster, Pa. 18974

[21] Appl. No.: 931,780

[22] Filed: Aug. 7, 1978

[51] Int. Cl.[2] ..... A63B 69/36

[52] U.S. Cl. ..... 273/186 R; 273/195 A

[58] Field of Search ..... 273/186 R, 186 B, 186 C

[56] References Cited

U.S. PATENT DOCUMENTS

| | | | |
|---|---|---|---|
| 3,513,387 | 5/1970 | Mayeda | 273/186 R X |
| 3,601,408 | 8/1971 | Wright | 273/186 R |
| 3,685,833 | 8/1972 | Jack | 273/186 R X |

FOREIGN PATENT DOCUMENTS

| | | | |
|---|---|---|---|
| 930715 | 7/1963 | United Kingdom | 273/186 R |
| 1511051 | 5/1978 | United Kingdom | 273/186 R |

*Primary Examiner*—George J. Marlo

*Attorney, Agent, or Firm*—Eugene Chovanes; Edward Lovett Jackson

[57] ABSTRACT

To analyze golf strokes, the disclosed device has a mat assembly and a console, the mat assembly preferably including an electrically conducting base plate, mat, artificial grass, tee and eight special switches. The switches are arranged one behind and another in front of the tee, with the other six forming an oblong rectangle extending along the path of the stroke from somewhat behind to well in front of the tee, with four of them at the corners of the rectangle and the other two half way along its long sides. The analysis includes a for evaluating a golf club swing, which method compares "I" with "II", "I" being the time it takes for a swung gold club head to travel from a first pair of the six switches (actuated just prior to passing the golf ball position) to a second pair of the six switches (actuated just past the golf ball position) and "II" being the time it takes for the golf club head to travel from the second pair of switches to the third pair of the six switches.

Each switch has an elastomeric feeler extending well up beyond the mat member, and a solid contact surface behind and spaced from the feeler and lower in height than the feeler, with a thin, flexible conducting strip of the same height as the solid contact surface attached to the back of the feeler and moving with it, and an insulating strip lower than the flexible conducting strip between the flexible conducting strip and the solid contact surface.

The console is actuated through a special electrical setup including the switches and has separate lights showing for a limited time a comprehensive analysis of the stroke, including whether its velocity accelerates in its further part, the general path it takes for an extending distance not limited to that close to the tee, whether or not it is a case of hitting "fat" or a divot shot, and whether the club face is angularly out of true in either horizontal direction or not.

7 Claims, 10 Drawing Figures

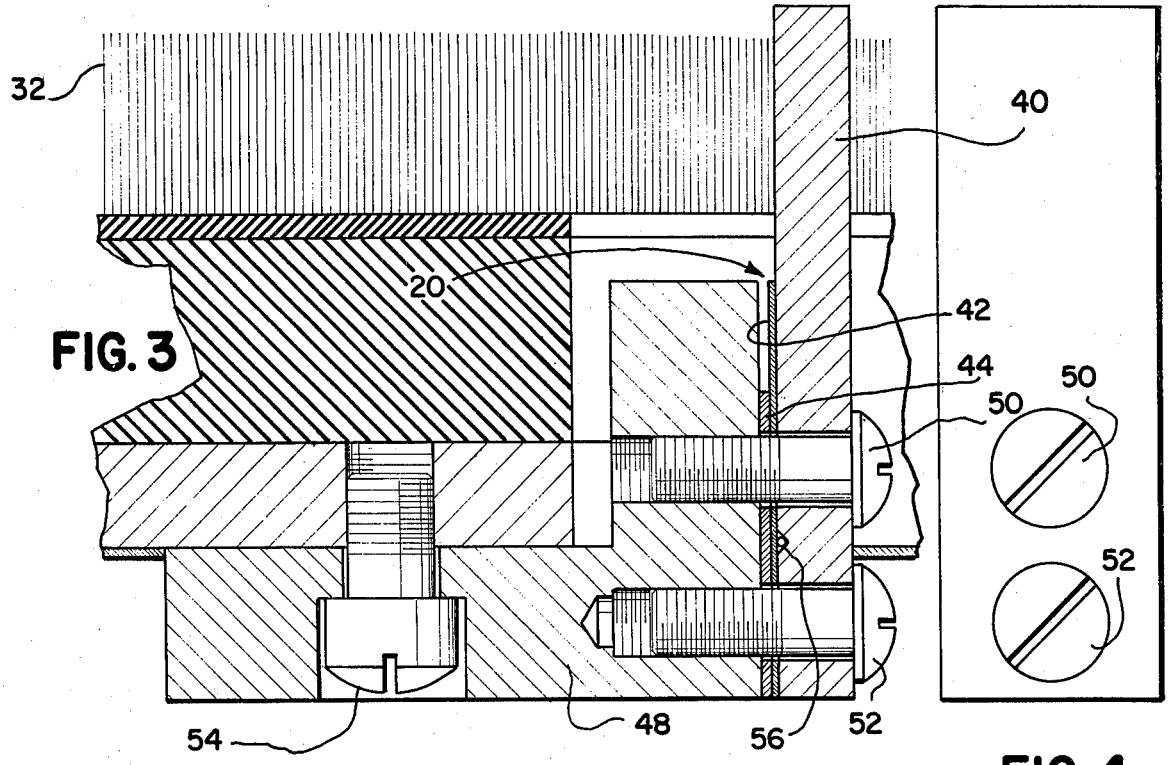
FIG. 3
FIG. 4
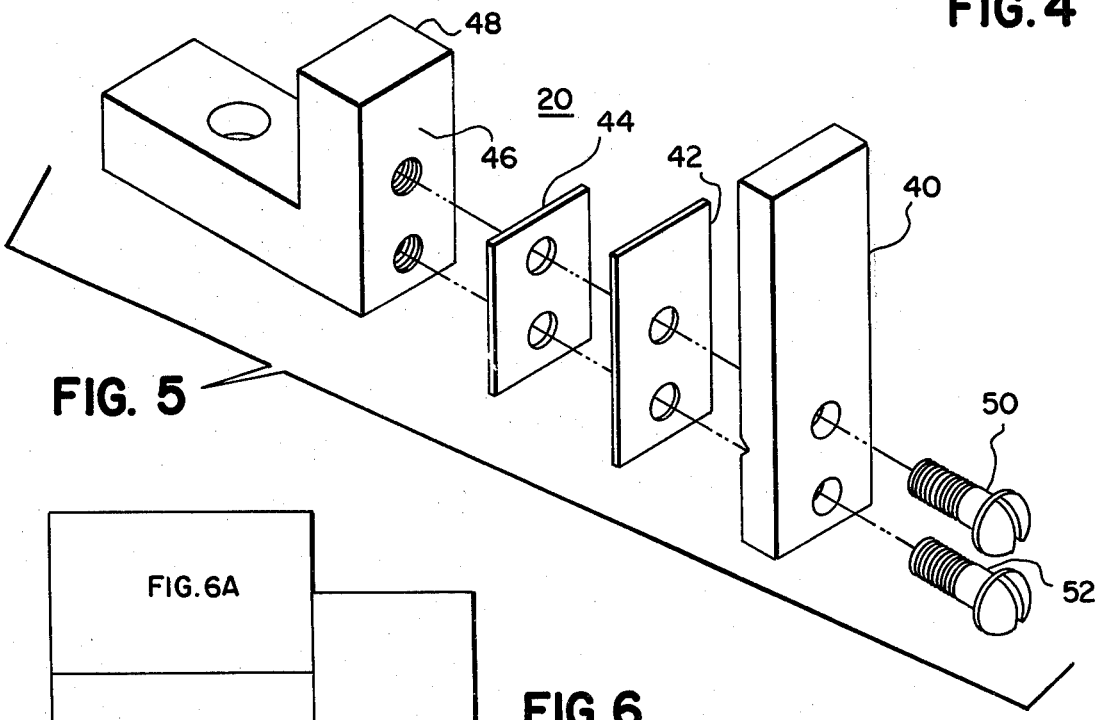
FIG. 5
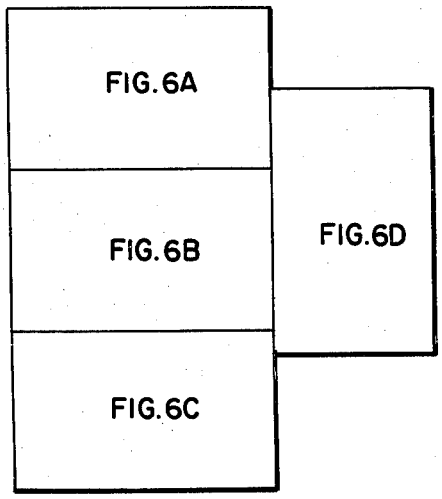
FIG. 6

GOLF STROKE ANALYZER

BRIEF SUMMARY OF THE INVENTION

This invention involves a golf stroke analyzer.

As is well known, an aspect which is of especial importance to the golfer in improving his play is the development of a proper stroke—one which will avoid as far as possible all the numerous faults into which golfers are prone to fall.

A purpose of the invention is to provide a means by which a golfing instructor or golfer can get very definite and certain information on whether a golfing stroke is substantially correct in all important respects, and if as most usual it is not, then he can learn what the particular respects are in which it falls short.

The stroke analysis in the present invention is intended to be especially comprehensive, and to give information which is especially beneficial to the golfer and especially pertinent to what he needs to know.

Among other things, it is intended to have special value in that it will determine whether the stroke continues to increase in speed beyond the general area where contact with the ball would be made, a factor important in getting the maximum distance from hitting the ball.

Also, it is intended to enable determination both of the path of the club head and also whether or not the club face maintains a transversely perpendicular position to the club's path, over an extended portion of the club's path. Furthermore, it is intended to give some indication of whether the bottom of the clubhead is in a proper position relative to the ground and the intended flight of the ball.

Furthermore, the present invention will affirmatively inform the golfer whether or not he is hitting "fat"—that is, whether his stroke comes so low at some place before the ball is hit as to make contact with the ground so that the golfer will waste part of the power of the stroke and possibly also lose some of his control over its direction and other attributes. The present invention also is intended to enable the golfer to determine whether or not a divot has very likely been taken by striking the ground beyond the position of the ball, which taking of a divot is usually undesirable in the case of the use of a driver or other wooden club, but is often desirable or even essential with irons.

A further purpose of the invention is to provide a means which can produce such an analysis of a golf stroke without introducing the slightest hindrance or annoyance with regard to the golfer's making a completely natural swing, such as he would make in the absence of any such analyzer.

A comprehensive and effective golf stroke analyzer such as the present invention has special value for the golfing professional as well as for the golfer himself.

As will be evident, when a golfer is attempting to improve his stroke by his own efforts, such an analyzer makes it possible for him to get an immediate objective indication of how he is doing and wherein any special faults lie without the necessity of going on each occasion to the golf course, driving range or practice green, and the objective indication that he receives is not distorted by the possibility of making lucky hits with an essentially faulty stroke.

For the professional, a truly good analyzer has a special advantage in his activities in the teaching of individual players who want his help. When he watches the player make his individual swings, he should if possible make keen observation of both the way the player's arms, legs, body, head, etc. behave and also of the position and path of the entire club throughout the swing. However, this is a great deal to observe, and the club, and especially its head, is moving so fast in the climactic parts of the swing that it would be extremely difficult to get a true and exact idea of what was happening to the golf club even if it were possible to concentrate on it alone. Use of the present golf stroke analyzer enables the professional to concentrate on other things besides the club head throughout the swing and then immediately afterwards to get a true idea of what the club head was doing, as a part of the total picture, thus enabling him to give the golfer better advice than he otherwise would.

SHORT DESCRIPTION OF DRAWINGS

FIG. 3 is a still further enlarged elevational view, broken away and partly in section, of a particular part of that mat setup, including especially a switch.

FIG. 4 is a view of a switch such as shown in FIG. 3, taken from beyond the end involving the feeler toward that feeler.

FIG. 5 is an exploded perspective view of such a switch.

FIGS. 6, 6A, 6B, 6C and 6D show schematically a preferred embodiment of the electrical setup of the present invention, with FIG. 6 itself showing merely the interrelation in overall position of the other figures, each of which is devoted to a different part going toward making up the electrical setup as a whole.

DETAILED DESCRIPTION OF A PREFERRED SPECIFIC EMBODIMENT

Figure 1:
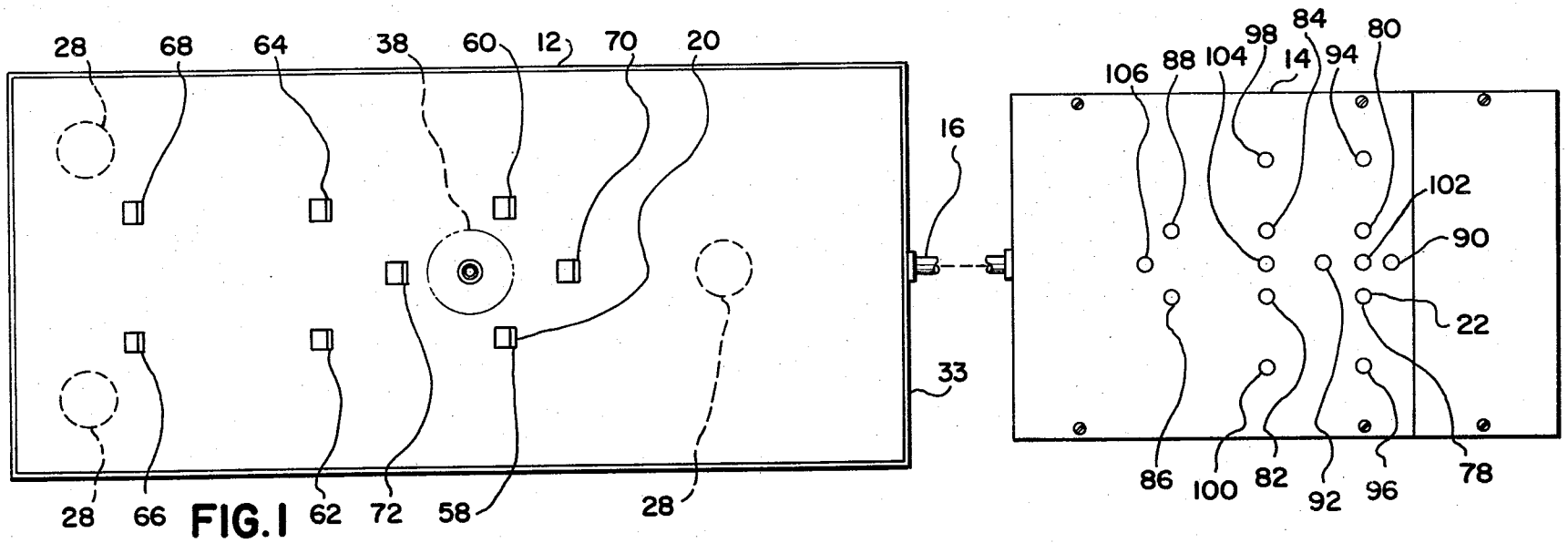
FIG. 1 is a diagrammatic plan view of a particular preferred embodiment of the golf analyzer of the invention, with the cable broken away.
Figure 2:
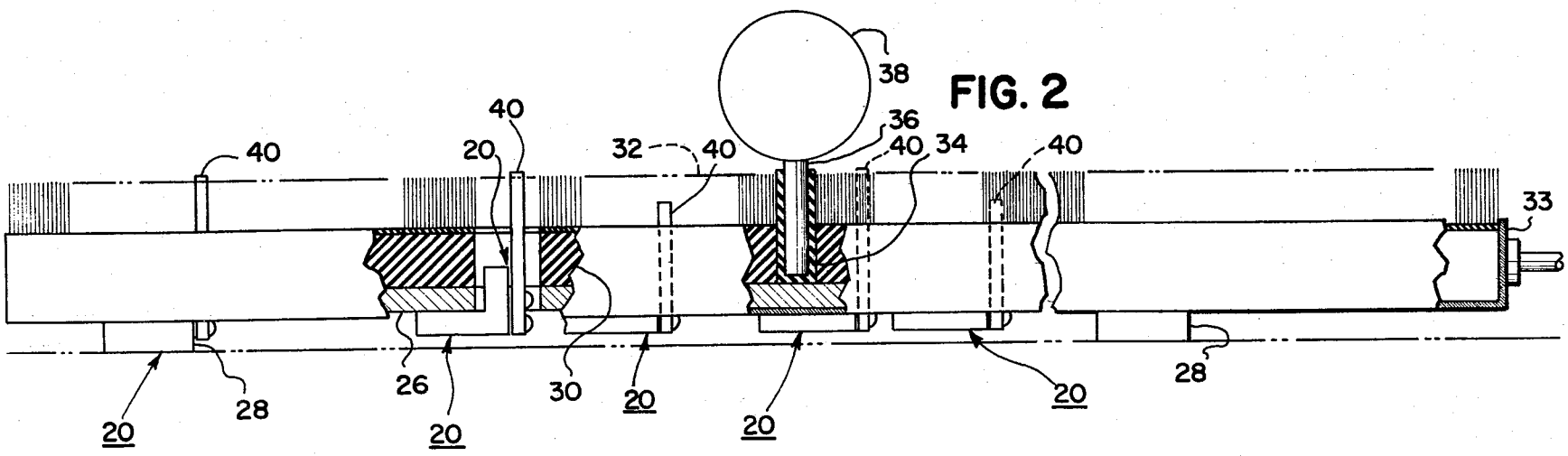
FIG. 2 is an enlarged elevational view, partly broken away, of the mat setup of this same embodiment of the invention.

Describing in illustration and not in limitation and referring to the drawings, with the description centering on the preferred particular embodiment of the present invention, which is shown in those drawings:

Physically speaking, the embodiment of the present invention illustrated in the drawings consists of a mat setup 12 and a console 14, joined together by a flexible electric cable 16, which cable is part of an electrical setup 18 which includes and interrelates switches and lights, of which particular examples will be found at 20 and 22 respectively, the setup being energized by any suitable source 24 of direct current power of suitable voltage, such as five volts. This power source can for example preferably be a suitable battery or batteries, thus making the device portable to places removed from ordinary domestic power sources or as another suitable possibility it can be an ordinary alternating current power source together with suitable ordinary well known voltage reduction and current rectification.

Mat setup 12 includes electrically conductive base plate 26, which is preferably of steel, rectangular in general overall outline, and approximately one-quarter inch thick. In addition to providing the current, it provides stabilizing weight. It rests on three feet 28, two located toward the corners of one end of the base plate, and the other in the middle of the other end. The feet are preferably compressible and most preferably of low durometer rubber such as sponge rubber, and in such case provide adequate support while at the same time minimizing any shock from a badly executed swing. On top of the base plate is a compressible mat, secured to the base plate, which gives protection to the golf club and the switches. It is preferably of neoprene rubber of 10 durometer and approximately one-half inch thick. On top and secured to the compressible mat 30 is artificial turf 32, preferably approximately three-eighths of an inch thick. As any sports enthusiast is aware, there are now in active use in numerous playing fields in such sports as major league baseball, for example, artificial turfs such as for example the artificial turf known as "Astroturf." This is a form of artificial turf in which durable green plastic blades generally simulating grass have been actually woven into a base, producing an overall product which lasts well and is considered entirely suitable for the present mat assembly, and is a regular commercial product of long standing made and sold by Monsanto, the product which Monsanto designates as "S-22" being for example entirely suitable. Tartanturf, another commercial product in actual use in major league baseball, is another example of a particular thing which would likewise be suitable.

The base plate and mat preferably have around their edges a casing 33, preferably in the form of aluminum angle material.

Some suitable holder 34 resting on the base plate and held in a hole in the mat holds a suitable teeing device 36, which extends above the artificial turf and upon which a golf ball 38 can for example be placed.

Switches 20 for use in the mat are of special construction.

Flexible feeler or actuator 40, preferably of rubber, of an ordinary type of gasket material, is in the form of a strip extending up at least beyond the top of the compressible mat, the exact distance it extends up being different in the case of different switches. The actuator is most preferably approximately one-eighth inch thick, and preferably within the range from one-sixteenth to one-quarter of an inch thick.

Behind it is flexible conducting strip 42, preferably of brass shim stock three to seven mils thick, and most preferably four mils thick, whose top is much below that of the actuator.

Behind brass strip 42 is insulating strip 44, preferably of nylon five to twenty-five mils thick, most preferably about 15 mils thick, which will extend upward to a place sufficiently below the top of the brass strip to enable the brass strip temporarily to bend all the way over it to a point at least even with its further edge when the actuator is struck; preferably the top of the insulating strip is about three-sixteenths of an inch below the top of the brass strip.

Behind insulating strip 44 is conducting surface 46, preferably forming part of angle 48 which can best be of aluminum, and has its top approximately as high as the top of the brass strip.

The actuator 40, brass strip 42, insulating strip 44, and aluminum angle 48, are all preferably held together by nylon screws 50 and 52. Aluminum angle 48 is in turn held on the base plate by means of a screw 54 extending up from below through the bottom horizontal member of the aluminum angle, so that the various other parts enumerated, including the other part of the aluminum angle, stick upward in the base plate and mat.

The switch of the present invention is especially well adapted for use in the present setup.

When a golf club is swung properly in such a manner as to contact certain activators and close certain switches in its path, the contact between club head and actuator is neither heard nor felt, either by the person making the swing or any interested onlooker, such as a golfing professional who is trying to help him with his stroke. This contact thus is not the sort of thing that would by any means deface or damage a golf club or even result in appreciable wear for it.

The stroke can thus be made just as it would be were no actuator nor switch there, and is not affected by the presence of the actuator. This is highly desirable in order to get an exactly true picture of the stroke, and to avoid even the slightest adverse psychological effects from real or fancied differences created by the analyser. Yet the switch is a highly durable one. Furthermore, despite the fact that it is thus so sensitive as to record the passing through of the clubhead without any apparent effect that the golfer is aware of, on the other hand it is not subject to false indications from jarring of the mat where no contact with the actuator was made.

For example, the mat can be deliberately kicked as hard as can conveniently be done, yet false lights will not show up on the console.

These attributes are highly special attributes, very desirable to achieve in the context of the present setup and not something that would just naturally happen to occur in an ordinary switch which might be turned to, but quite the contrary. The great majority of even somewhat durable switches which might be thought of for this purpose would be too stiff in actuation and would make the golfer very conscious of the fact that contact had been made by this clubhead to close the switch. Indeed, the contact would be very likely to be a sufficiently strong one to eventually destroy the switch actuator before it had lasted to the full extent desired, or even conceivably to eventually cause some marking or defacement of the head of the golf club.

Furthermore, in most ordinary switches that might be thought of, vibration would be sufficient of a problem to cause false indications on numerous occasions.

A wire 56, running through a depression left in the face of the actuator, is attached, as for example by soldering, to the brass strip and connects it into the electrical setup at the appropriate point.

The invention preferably has eight such switches. Switches 58, 60, 62, 64, 66 and 68 are located in a double row starting about even with the back edge of the golf ball and going on in two preferably equal increments in the direction in which the golf stroke proceeds to a point several inches beyond that golf ball. The switches of each of the three pairs of switches going to make up the double row in question are spaced equal distances on opposite sides of the path of a straight swing through the golf ball, so that the six switches in question form two rows of three symmetrically spaced on opposite sides of that swing path. The switches in each pair, and thus the two rows, are spaced apart from each other by an amount which is substantially less than the length of a club head in golf, of whatever description.

The actuators of these six switches extend upward to such a height that in a perfect swing aimed at a ball on the tee, the golf club will in all cases make substantial contact in its path with all of them.

For example, in a permissable case, preferably the tee for the ball will extend slightly above the top of the artificial turf, most preferably about one-eighth inch above. The actuators for switches 58 and 60, the ones in line with the back edge of the ball, and the actuators for switches 62 and 64, the ones nearest beyond the ball, will then most preferably extend to about one-sixteenth of an inch above the top of the artificial turf, or less desirably, somewhere else in a range from five-sixteenths of an inch above down to one-sixteenth of an inch below that top. The actuators for switches 66 and 68, further along in the stroke where the normal path of the golf club will be at a somewhat higher point, will most preferably extend up to about an eighth of an inch higher, and thus most preferably to about three-sixteenths of an inch above the top of the artificial turf.

The other two switches, 70 and 72 respectively, will be respectively directly behind and directly in front of the golf ball, in a relatively close position in each case, and their actuators will extend upward in each case not nearly so high as the previously mentioned actuators—their tops being most preferably in each case about three-sixteenths of an inch below the top of the artificial turf, or somewhat less desirably a quarter inch below.

The placement of the tops of these last two switch actuators should in any case be such that in a perfect swing for a driver or other wooden club, the golf club will in all cases pass above each actuator without hitting it.

On the other hand, if the stroke is one that would hit "fat" in the parlance of the game, or in other words, if it is a stroke which when made in the course of play would hit the ground in front of the ball before it hit the ball, and thus partly dissipate the energy and lessen the control of the stroke when the club was coming up to the ball—then the club will hit the actuator of switch 70.

If on the other hand, the stroke is such that the golf club would hit the ground after it hits the ball, in the course of play, then the actuator of switch 72 will be struck. This would with rare exceptions be a fault where the stroke was by a driver or other wooden club, but in many if not most cases would be a desirable thing in the case of an iron, since with irons the taking of divots often has decided value from such standpoints as imparting appropriate spins or dealing with bad lies.

The electrical setup includes among other things a light on the console to correspond with each switch, with appropriate circuitry to cause the light to light up whenever the switch actuator is struck, and thus whenever the golfer has a stroke which would hit "fat" or take a divot if made on a golf course, his contact with the switch actuator will cause a light to light up to inform him of that fact.

More specifically, the console has quite a number of lights, and the six lights 78, 80, 82, 84, 86 and 88 correspond respectively with the six switches already described as located in a double row parallel to the path of a perfect swing, while lights 90 and 92 correspond to switches 70 and 72 respectively which have already been described as representing hitting "fat" and taking a divot, respectively.

Lights 94, 96, 98, 100, 102 and 104 have to do with whether the club face maintains a position which is perpendicular relative to the flight path intended for the ball, from the standpoint of an observer from above, or whether on the other hand its position is such that the toe of the club is further advanced than its heel or vice versa. This is of course important as far as concerns getting the ball to go in a perfect line in the direction intended, instead of at least somewhat off to the right or to the left.

Whe the club head strikes the actuators for switches 58 and 60 simultaneously, within whatever tolerances are considered suitable and are therefore set for the device, then this of course means that the club is perpendicular in the above sense within that tolerance at that point, which is approximately where the club head would strike the ball, and light 102 is provided between lights 78 and 80 to light up to denote that fact, as a result of the operation of suitable circuitry which will be gone into.

When the club head does the same thing as to the actuators for switches 62 and 64, this of course means the club face is thus perpendicular at that further point, a few inches further on the path of the club, and light 104 is similarly provided between lights 82 and 84 to light up to indicate that fact.

When the club head does not strike the actuators for the switches in question simultaneously at either or both places, lights 94, 96, 98 and 100 tell which switch actuator it strikes first in each such position and therefore which end of the club head was ahead of the other there.

Specifically, when the club head strikes the actuator for switch 58, located closer to a right handed golfer than the ball, before it strikes the actuator for switch 60, which is located further away, this indicates of course that at that point, approximately the point where contact would be made with the ball, the nearer part club face, or in other words the part toward the heel of the club, is further advanced than the horizontally further part, or in other words, the part toward the toe of the club. Since such a position has a tendency to make the ball depart from the true line by going at an angle away from the golfer or in other words to the right of the intended line of flight, there is provided light 94 which is located on the console at a further out position in the same direction away from the center line as light 80, and when this lights up this indicates such an angle of the club face, which in such situation is known as an "open" face, and is said to produce a "pushed" shot.

On the other hand, when at contact with the ball the part of the club face toward the toe in the case of a right-handed golfer is further advanced than that toward the heel, so that the actuator for switch 60 is struck before the actuator for switch 58, there is lighted up light 96 which is on the same side of the center line as light 78, but further away from the center line than that other light. This indicates a so-called "closed" face, producing a so-called "pulled" shot, in which the ball travels toward the left of the intended line of flight, in the case of a right-handed golfer.

Lights 98 and 100 are respectively similarly positioned relative to lights 84 and 82 and respectively represent similar things at a position of the stroke a few inches further forward, a result of the club face's contact with actuators for switches 62 and 64.

Another aspect of a stroke which can be undesirable especially when it is grossly away from normal, is the condition of having the bottom of the clubhead in a sufficiently abnormal position, so that the club heel is greatly below what it should be relative to the club toe, under all the circumstances, or vice-versa, thus having the effect of distorting the angle of loft which the particular clubface was indended to have. This may be especially important in the case of a lofted club such as a wedge or No. 9 iron, the angle of whose face relative to the perpendicular is great.

An indication of any such gross abnormality is received when a swing actuates all the switches on one side of the center line and none of those on the other side, even though there is no indication at the time that the swing was greatly off from the line of flight,—something of which the golfer would probably be instantaneously aware at the time of the swing without any need for any special indication from any lights to tell him about it.

Another important thing in getting off a good shot at golf is that there be good follow-through, one that is not only straight, but vigorous as well. Preferably, the clubhead should travel even faster for a substantial distance after it hits the ball than it does around the time it hits.

This present golf stroke analyzer is set up to measure this, by having switch actuators 62 and 64 equal in distance from switch actuators 58 and 60 behind them, on the one hand, as compared to the distance they are from switch actuators 66 and 68 beyond them, on the other hand, and comparing the time taken by the clubhead to cover these two equal distances. If the clubhead takes less time in covering the distance between switch actuators 62 and 64 and 66 and 68 beyond them then it did in covering the distance between switch actuators 58 and 60 and 62 and 64, which is true of the ideal stroke, then light 106, located on the center line of the console to the left of the other lights, will light up to record this fact.

The system is set up to operate after the swing to keep the lights on for a reasonable set time to enable them to be viewed and their message duly received, and then to automatically go off and leave the device ready for a further swing. The system can be set up to have this time when the lights of the console remain on be fixed to suit the particular intended user, but ten to twelve seconds is likely to be a good time to leave the lights on, especially ten.

An illustrative preferred example of an electrical setup suitable to achieve these results is shown schematically in FIGS. 6 and 6A through 6D, FIG. 6 being merely to show the interrelation between the other figures.

While the schematic electrical diagram will be largely if not wholly self-explanatory to one skilled in the art, we will go into it in some detail to be informative by giving a specific preferred example, without intending to imply that the specifics given are necessary to achieve a reasonably good result along the particular lines involved. The description of the electrical system will in most cases be simultaneously coupled with a description of what it does.

The particular embodiment in question of the electrical system, which can be manually turned on or off as a whole by a conventional push button or other switch (not shown), connects to some source of direct current power 24, such as preferably a 5-volt battery, at its positive terminal. When the power is on, the other terminal of the battery is grounded by some conventional means, as is the other end 120 of the system, there being in fact more specifically a number of points 24 in the system connected to the positive terminal of the 5-volt battery and quite a number of points 120 in the system connected to ground, as the conventional representation of ground there shows. While the schematic diagram shows the circuit as conventionally having its return through ground, actually the return will preferably be one directly made to the negative terminal of the battery or other source of direct current, so that all the various points conventionally represented in the schematic diagram as connected to ground, will in fact be directly connected to the negative side of the source of direct current power, through a conductor or conductors of suitable current carrying capacity for the purpose.

In the schematic electrical diagram, the switches and lights are identified by the same numbers as in the rest of the drawings.

Figure 6A:
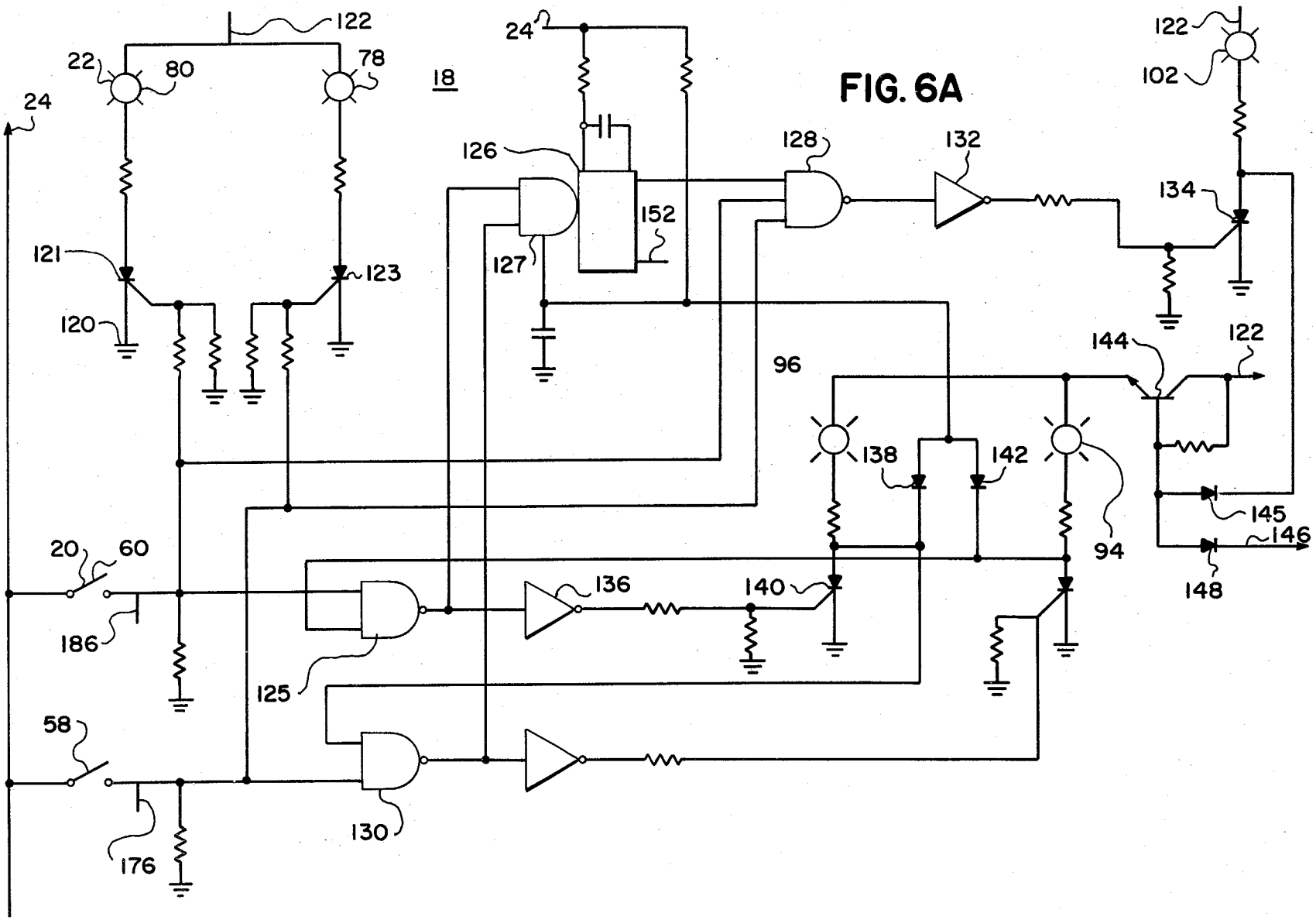

FIG. 6A shows a part of the circuit which includes switches 58 and 60 and lights 78, 80, 94, 96 and 102.

When in a stroke the club head strikes the actuator for switch 60, for example, and thereby momentarily closes that switch, this applies the direct current voltage, through a resistance, to silicon controlled rectifier 121, in a manner to cause current to start flowing through light 80, causing it to light up. The current in question flows through interconnection 122 from the part of the circuit shown on the right in FIG. 6C, which has a connection from the positive of direct current voltage source 24, and includes reset 124, whose function in its relation to the rest of the electrical setup is to permit the current to continue to flow through the silicon controlled rectifier 121 and light 80, despite the fact that the switch 60 has reopened, for a period which terminates when reset 124 affirmatively shuts it off.

The identical thing happens in case of a stroke contacting a particular switch actuator, with all other switches and all the other lights directly corresponding to them, respectively, such as for example switch 58 and light 78 in FIG. 6A, which connect through a resistance and silicon controlled rectifier 123.

Switch 60 is also connected to 3-element NAND gate 128 and to 2-element NAND gate 125, which in turn is connected to an input terminal of monostable multivibrator 126, which likewise is connected by its positive output terminal to 3-element NAND gate 128. The multivibrator also has suppressor terminal 127 connected as shown, to prevent its starting up over again when a second light comes on.

Switch 58 has a similar set of interconnections involving 2-element NAND gate 130, connected to the multivibrator's other input terminal, instead of 2-element NAND gate 125, but including multivibrator 126 and 3-element NAND gate 128 in the analogous interrelations.

When either of these switches 58 or 60 is closed, it starts the multivibrator for the period for which it is set, which preferably is around 100 microseconds, but depends on the tolerance already mentioned as involved for substantial simultaneity between switches and thus the tolerance for horizontal perpendicularity of club head to desired path of stroke. If during this period the other of these two switches 58 or 60 is closed, then all three required elements for the functioning of 3-element NAND gate 128 are positive at the same time, and the gate functions through hex inverter 132 and silicon controlled rectifier 134 to light light 102, which then stays on for the preset period as a result of it also tying in to reset 124 and its associated part of the circuit by interconnection 122. Thus, simultaneous actuation of switches 58 and 60, within the preset tolerance, as a result of the club face being in substantially perpendicular position from the horizontal standpoint, operates to turn on light 102, and keep it on for the preset period.

2-element NAND gate 125 is also connected in its output through hex inverter 136 and silicon controlled rectifier 140 to light 96. Thus if conditions are otherwise right, closure of switch 60 will also light up light 96.

However, one of the input elements in 2-element NAND gate 125 is connected to light 94 in the manner shown, and the effect of the circuit in this respect is that 2-element NAND gate 125 will not function to light light 96 if light 94 is already on.

Furthermore light 102 is connected through rectifier 145 to the base of NPN transistor 144, whose collector is connected through interconnection 122 to reset 124 and whose emitter is connected to the other side of lights 96 and 94. If light 102 lights up, the effect of this is to remove the voltage from light 96 and cause it immediately to turn off, within the 100 microsecond period it takes to determine whether light 102 will be lit. However, if this does not happen, it remains on for the preset period as a result of the connection to reset 124.

Thus, when switch 60 is closed, light 96 will light up and remain on if and only if neither light 94 nor light 102 are on or go on. Thus it denotes the fact that switch 60 was closed first, rather than substantially simultaneously with or after the other switch.

An exactly analogous setup for light 94 with its 2-element NAND gate 130 behaves similarly in its own case, if the club face first contacts the actuator for switch 58 rather than contacting the switches substantially simultaneously, or contacting first the actuator for switch 60.

Figure 6B:
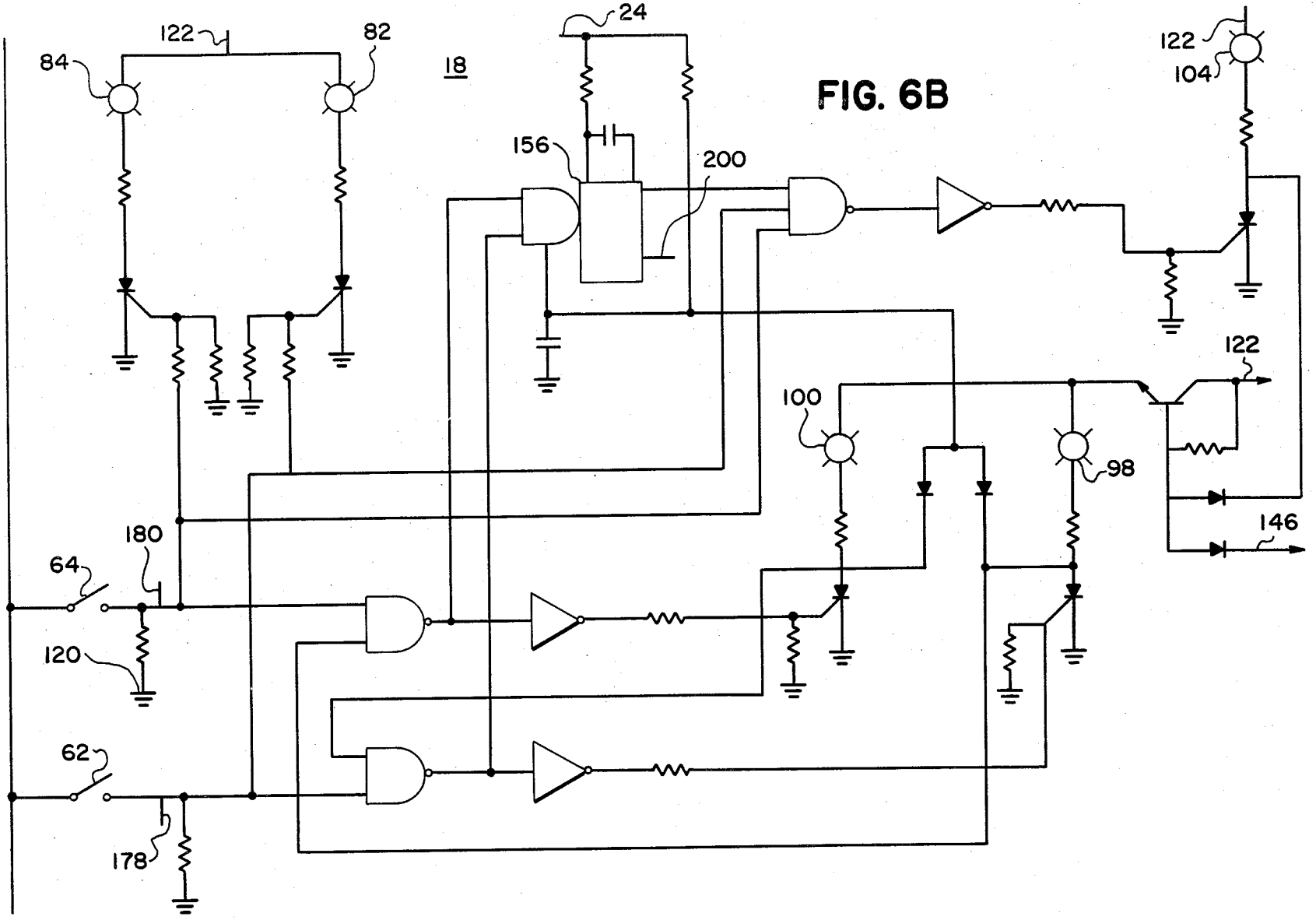
Figure 6C:
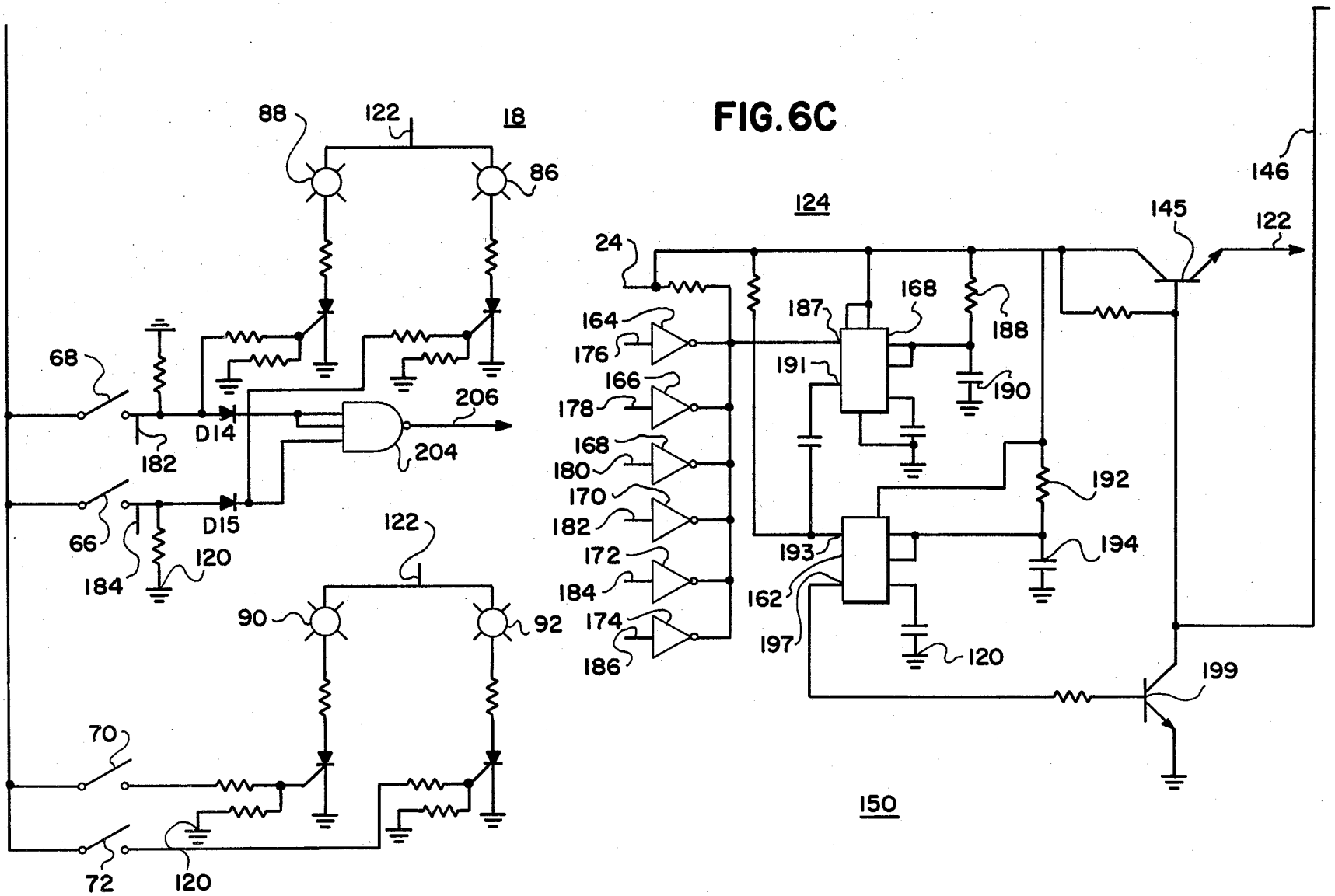

Also connected to the base of NPN transistor 144, through interconnection 146 by way of rectifier 148 is the reset 150, involving another aspect of the setup shown in the right hand portion of FIG. 6C.

With one exception, FIG. 6B shows an analogous circuit setup for switches 62 and 64 and lights 82, 84, 98, 100 and 122, as compared to that for FIG. 6A for its switches and lights, and the circuit setup of FIG. 6B functions identically for its switches and lights as does that of FIG. 6A for its switches and lights.

Figure 6D:
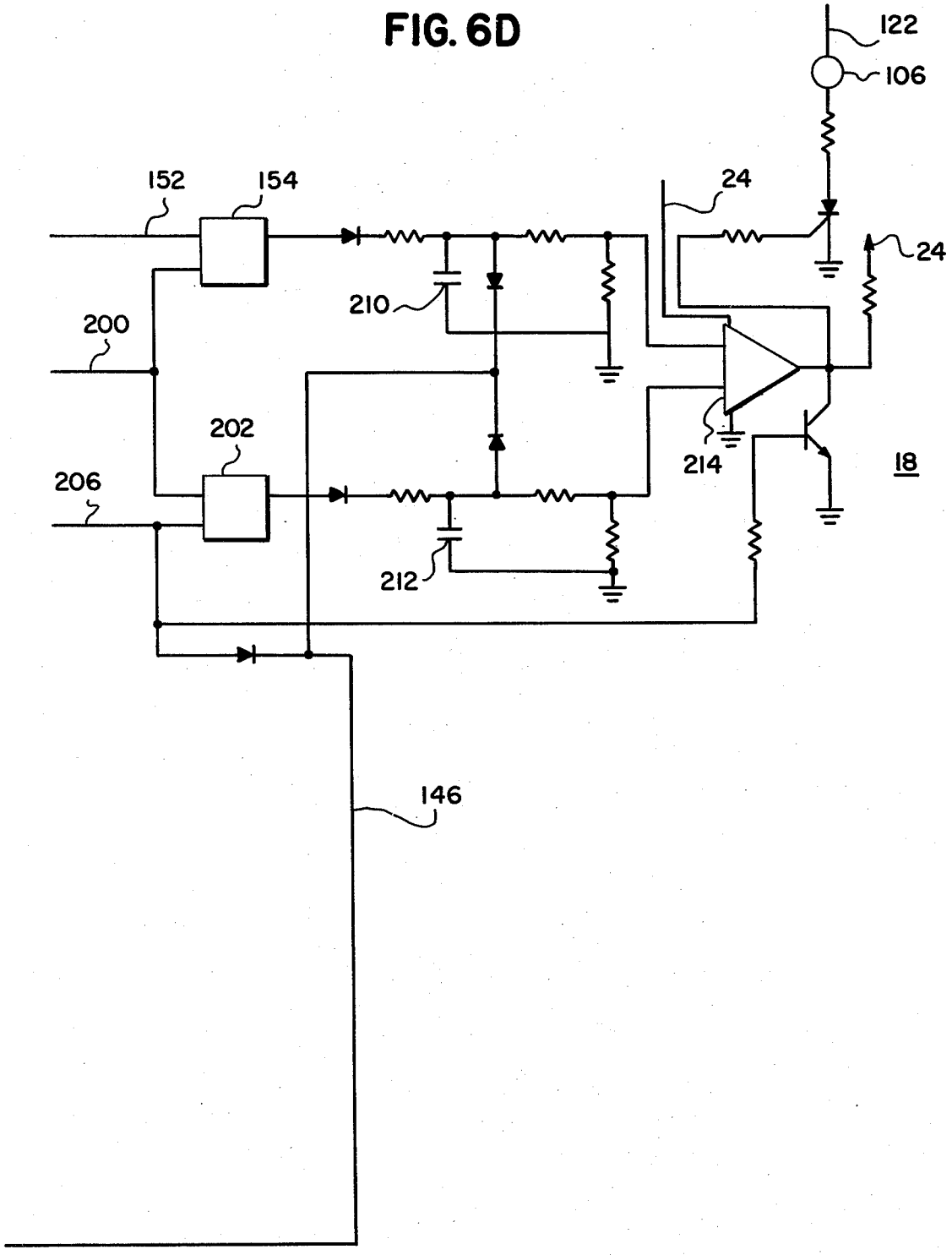

The one exception to the identical analogy between the circuit shown in FIG. 6A and that in FIG. 6B lies in their respective interconnections with the circuit setup of FIG. 6D, which will be gone into.

As already indicated, the righthand side of FIG. 6C shows in one aspect reset 124 and in another aspect reset 150.

In these resets a duel timer operates, made up of timer 160 and timer 162. Inverters 164, 166, 168, 170, 172 and 174, all wired "or", are respectively connected by interconnections 176, 178, 180, 182, 184 and 186 to switches 58, 62, 64, 68, 66 and 60, so that each will operate when its respective switch closes. The inverters are wired to the input terminal 187 of timer 160, so that the timer will start up on the closure of the first to close of the switches in question.

Timer 160 then continues on a preset timing cycle determined by the values of resistance 188 and condenser 190 involved as shown in the timer, which as already indicated is most preferably 10 seconds, but may be adjusted to suit convenience as to how long the lights will stay on. When the end of the timing cycle occurs, timer 160, whose output terminal 191 is connected through a condenser to the input terminal 193 of timer 162, operates to start that timer and at the same time the setup, which has NPN transistor 195 as indicated in the line between interconnection 122 and the positive terminal 24 of the DC voltage, operates to turn off the lights.

At the same time as timer 160 is reset at the end of its cycle, the cycle of timer 162 begins, lasting for a time determined by resistance 192 and condenser 194 involved as shown in the timer, which may suitably be one second, for example, after which everything is ready for another golf stroke.

Output terminal 197 of timer 162 is connected as shown to the base of NPN transistor 199 which in turn is connected as shown to the base of transistor 195 and also to interconnection 146.

In the middle and upper left of FIG. 6C is shown the circuit involving switches 66 and 68 and lights 86 and 88, which will be noted to be in effect pretty much a rather simplified version of those involving lights 78 and 80 for example, but with a particular interconnection to the circuit of FIG. 6D from the 3-element NAND gate.

In contrast, the lower left of FIG. 6C will be seen to show switches 70 and 72 and lights 90 and 92 in another such simplified analogous version, but without any 3-element NAND gate.

Taking up the part of the electrical setup involved in FIG. 6D and its interconnections, the Q bar of the monostable multivibrator 126 of FIG. 6A connects through interconnection 152 into the set terminal of first flip flop 154 in FIG. 6D.

On the other hand, the Q bar of the monostable multivibrator 156 of FIG. 6B connects through its interconnection 200 into the reset terminal of flip flop 154 in FIG. 6D and the set terminal of flip flop 202 in that Figure.

The output of 3-element NAND gate 204 of the circuit of switches 66 and 68 and lights 86 and 88 in FIG. 6C connects by interconnection 206 with the reset terminal of flip flop 202 of FIG. 6D.

Thus when either of switches 58 or 60 is closed by the club head reaching the point where that pair are, which is about or at any rate near the point of contact with the ball, flip flop 154 is set and this continues in this condition until the club head reaches a point several inches away and closes either of switches 62 or 64, resetting flip flop 154. During this period condenser 210, to which the flip flop connects through an ordinary rectifier, such as a diode, and a resistance, is building up in voltage, and the amount of the buildup is determined by the amount of time between the set and the reset of the flip flop, and thus is determined by the time that the club head takes to travel that distance.

Similarly, as a result of the time between set and reset of flip flop 202, condenser 212, similarly placed with relation to it, is charged and the buildup in voltage of it bears a similar relation to the time the club head takes to go between the first of the actuators for switches 62 and 64, on the one hand, and the first of the actuators for switches 66 and 68, on the other. The overall circuit in question ties the condensers in question in to the respective two input terminals in comparator 214 in the manner there shown, and if the buildup of the condenser 210 is greater than the buildup of condenser 212, showing that the club head has taken less time to go the further of the two distances, the comparator so indicates by sending a current through silicon controlled rectifier 216 and light 106, lighting that light, which stays on for the predetermined time as a result of its connection with the reset 124 through interconnection 122. Thus, light 106 goes on when the stroke accelerates in its further path, as is true of the ideal stroke.

In operation, the mat assembly should be set in a suitable swinging area, and the console behind the mat and away from the path of the club swing.

The mat may be set level or any attitude of uphill, downhill, tilted towards, tilted away from participant. This enables the golfer to practice on any of the infinite "lies" encountered during a round of golf. Use of a foot mat is recommended so that the feet are at the same elevation as the synthetic grass mat. The switch of the console should be turned to the "ON" position. With or without a golf ball (practice or live), a swing should be made over the mat with any substantial golf club, engaging the flexible actuators. After completion of swing, the light pattern should be examined to determine the results. The light pattern will stay "ON" for approximately ten (10) seconds in the preferred case; when lights go "OFF", the next swing may be taken.

As already indicated, switches 58 and 60 are part of a comparison circuit contained in the console. If during a swing both switches 58 and 60 are closed simultaneously, lights 78 and 80 of the console will turn "ON" and so will the bulb 102 positioned between them. This means that the face of the club was perpendicular to the line of flight at that point of the swing. Tolerance of the perpendicularity is controllable by solid state technology; it can be set so close or so broad that it would be impractical for human usage. If bulbs 78 and 80 are lighted by a given swing and bulb 102 is not turned "ON", then either the heel of the club contacted switch 58 first or the toe of the club contacted switch 60 first. With switch 58 contacted first, light bulbs 78, 80 and 94 will be "ON", telling the golfer that at this point the club had an open face. With switch 60 contacted first, light bulbs 78, 80 and 96 will be "ON", telling the golfer that at this point the club had a closed face. As already indicated, open faced club swings produce "pushed" shots, and closed face clubs produce "pulled" shots. As already indicated, this same circuitry exists between switches 62 and 64.

It is rather easy to swing over the mat and engage only switches 58, 62 and 66. Under this condition, bulbs 78, 82, 86, 94 and 98 will be lighted; however it does not prove that the club face was open. Bulbs 80, 84, 88, 96 and 100 could be turned "ON" with yet another swing; again it does not prove that the club face was closed. It follows then, the only time "Open" and "Closed" readings are valid is when pairs of switches 58–60 and 62–64 have been activated.

For the right-handed golfer, if only switches 58, 62 and 66 are closed, this portrays a shot hit off the club toe; it will be felt in the fingers. Conversely, if lights 80, 84 and 88 are the result of a swing, the ball has been hit by the club heel; when using iron clubs, this shot could result in a "shank."

As already indicated, the divot switch 72 has a shorter flexible actuator; a golfer must concentrate on having the lowest part of his swing ahead of the golf ball in order to light this bulb. As likewise indicated, the "fat" switch 70 has been provided to warn a golfer that he has hit the ground behind the ball and lost a portion of the power put into the swing.

As already indicated, the console contains light bulb 106. If maximum distance is to be obtained by a given swing velocity, the club head should accelerate after impact. The distance from switches 58 and 60 to switches 62 and 64 is equal to the distance from switches 62 and 64 to switches 66 and 68. If a golfer spends less time getting the club over the latter distance than over the former, then as has been indicated, the swing has been accelerated and light 106 will come on. Should the club head accelerate after impact, light 106 will come on. Should the club head decelerate after impact, light 106 will not come "ON."

A typical sliced (curving right) shot for a right-handed golfer would have lights 80, 84, 82 and 86 lit-,—an outside-to-in swing, producing clockwise rotation of the ball. For the left-handed golfer, a sliced (curving left) shot would turn "ON" lights 78, 82, 84 and 88,—again an outside-to-in swing, producing counterclockwise rotation of the ball.

The perfect shot for wooden head clubs consists of nine lights: 78, 102, 80, 82, 104, 84, 86, 88 and 106.

The perfect shot for iron head clubs consists of ten lights: 78, 102, 80, 82, 104, 84, 86, 88, 92 and 106.

One preferred possibility that is envisaged with the lights is to have the lights which do or can indicate a good or ideal stroke, such as lights 78, 80, 82, 84, 86, 88, 102, 104, 106 and 92, be in the form of green lights, while the lights which indicate aspects of a stroke which are always undesirable, such as lights 90, 94, 96, 98 and 100, would be in the form of yellow lights.

The various tolerances which are set to distinguish between the most desirable type of stroke in various respects and a deficient stroke in those respects such as the lack of simultaneity and thus the angle which will be adjudged to involve a closed or open face rather than a laterally horizontally perpendicular one, or the amount of increase of speed required for lighting the light denoting acceleration, should be set in a reasonable manner, avoiding both the extreme of such limited tolerances as to require unreasonable perfection to indicate success, which would almost never be attained, and the opposite extreme of such broad tolerances as to falsely indicate perfection in decidedly imperfect strokes and thus remove a great deal of any incentive to improve.

In view of our invention and disclosure, variations and modifications to meet individual whim or particular skill will doubtless become evident to others skilled in the art, to obtain all or part of the benefits of our invention without copying the specific setup shown, and we therefore claim all such insofar as they fall within the reasonable spirit and scope of our claims.

Having thus described our invention, what we claim as new and desire to secure by Letters Patent is:

1. A golf stroke analyzer comprising:

(a) A mat setup having artificial turf and a plurality of switches mounted in particular positions relative to the turf, each switch including an upwardly extending bendable feeler which extends upward at least as far as into the turf, an upwardly extending bendable metal strip against the feeler on the side of that feeler which is away from the direction from which the stroke is coming and the strip having its top located substantially lower than that of the feeler, insulation against the strip still further away from the feeler on that feeler's above-mentioned side, the top of which insulation is substantially lower than that of the strip, and a solid conducting surface beyond the insulation on the side away from the feeler and the surface having its top at approximately the same level as that of the strip, the mat setup including at least eight such switches—six of which have feelers which extend upwardly into the path of a normal stroke which would not contact the ground and are respectively arranged in three pairs with each pair at a different place in the stroke and the two feelers of each pair located less than a clubhead's length apart and symmetrically one on either side of the intended path of the stroke, the middle pair being located equidistant from the other two pairs, and the other two of the switches having their feelers with their tops below the tops of the feelers of the other six and located respectively one behind and one in front of the position in the stroke where contact with a ball if present would be intended, (b) a console setup having lights to show an at least relatively comprehensive set of pertinent characteristics of the stroke, and (c) an electrical circuit setup interrelating the above-mentioned switches and lights and including means to compare the time taken between the first and second above-mentioned pairs of switches on the stroke with the time taken between the second and third above-mentioned pairs of switches on the stroke, and light a light if the latter time is less.

2. (twice) A golf stroke analyzer comprising:

(a) an electrically conductive base plate, (b) three separate compressible feet supporting the base plate, (c) a compressible mat resting upon the base plate, (d) an area of artificial grass on the mat which grass extends up to a particular height, (e) a tee at a particular position relative to the grass to locate where the ball will be if used, relative to a golfer's swing, and adapted to hold a golf ball at that position and at a level above the top of the grass, (f) a plurality of elastomer feelers extending up from the base and each having a switch associated with it, which switch is adapted to be closed by substantial contact of the club head with the associated feeler in a given swing of a golf club, one of the feelers extending up to below the top of the grass directly in front of the tee relative to the swing, another extending up in similar amount directly in back of the tee relative to the swing, and six of the feelers extending up higher than the aforementioned feelers in pairs, each pair of feelers being abreast of each other relative to such a perfect swing, one on each side of the center line of a perfect swing at a distance apart from the other of the particular pair which is less than the length of a typical club head from shank to toe, with its particular ones on each side of the center line being respectively aligned parallel to that center line, and the pairs being one immediately behind the tee, a second pair in front of it in line with it relative to a perfect swing at a particular distance away from it, and the third pair in front of the second pair relative to a perfect swing at the same distance away from the second pair as is the second pair from the first, (g) an electrical setup and console including lights, which setup is adapted to close suitable circuits with closure of respective switches, which circuits once closed will at least temporarily stay closed and in that closed state provide for the lighting and the retaining at least temporarily in lighting of certain lights, which lights are arranged on the console and function as follows:

(1) a first light in the center on the far right on the console, which will light to represent substantial contact of the club head with the feeler directly behind the tee and thus will represent hitting "fat";

(2) a vertical line of light immediately to the left of the first light, the second and fourth of which vertical line will represent substantial contact of the club respectively with the righthand and lefthand feelers of the rearmost pair, while the third represents such contact being substantially simultaneous, whereas the first and fifth represent respectively to which side of a perfect path the ball is likely to go as a result of which contact came first in a substantially non-simultaneous contact, (3) a single light in the center to the left of the above vertical line, which single light represents contact with the feeler directly in front of the tee and thus hitting a "divot" shot, (4) another line of lights located to the left of the above single light and like the first line but representing aspects of the second pair of feelers similar to those previously mentioned for the first line as to the first pair of feelers, (5) a vertical line of two lights to the left of the immediately above-mentioned line and representing substantial contact with the third pair of feelers respectively, (6) a central light toward the left on the console, and representing the comparative time as between the initial contact with one of the first and with one of the second pair of feelers on the one hand and as between the initial contact with one of the second pair and with one of the third pair of feelers on the other hand, and which will light when the latter time is less than the former, thus representing a stroke which accelerates in that latter part.

3. A golf stroke analyzer comprising:

(a) a mat having (1) artificial turf extending upward, (2) a real or merely indicated ball striking position for a golf swing, and (b) a plurality of special switches each of which includes a vertically extending elastomeric feeler having a fixed end in the mat at the bottom and a free end at the top and a usual position extending up at least into the artificial turf, a solid electrically conducting surface spaced from that feeler and located beyond that feeler in the direction in which a golf swing properly through the ball striking position would proceed, a vertically extending flexible electrically conducting strip having a fixed end in the mat at the bottom and a free end at the top and which is attached to and moving with that feeler on the same side of the feeler but which in its usual position is also spaced from that surface, and a strip of solid electrical insulation between the flexible conducting strip and the solid conducting surface, and contacting both, the tops of the flexible strip and the solid conducting surface being both at approximately the same height as each other, which height is substantially below that of the top of the feeler, and the top of the strip of insulation being on a line substantially below the tops of the solid conducting surface and the flexible conducting strip, the switches being part of an electrical circuit setup in which setup there is above the aforementioned strip of electrical insulation in the usual position of the feeler an electrical gap between the solid conducting surface and the flexible conducting strip, which gap will be closed when the elastomeric feeler is bent in the way it would be by ordinary good contact by a golfing club head in a golfing stroke.

4. A golf stroke analyzer comprising a base, a plurality of electric switches mounted on the base each of which switches has a vertically extending elastomeric feeler having a bottom end fixed in the mat and a top end which is free and extends up into an area above the base where a golf club head could travel in a particular direction in a golf swing, a vertically extending flexible metal strip having a bottom end fixed relative to the mat and a top end which is free to move in accordance with the motion of the feeler and is mounted in a position where it extends upward on the feeler on the face of that feeler which is in the direction of such travel, said flexible strip being capable of substantial temporary deformation in that direction and its top being substantially below that of the feeler, a strip of solid insulation mounted where it extends upward and is located on the face of that metal strip which is in the direction of such travel but at a position in which its top is on a line substantially below that of the flexible metal strip, a flat solid surface of conducting material located to extend upward on and up beyond the top of the face of that insulation which is in the direction of travel and having its top approximately at the same height as the top of the metal strip, and electrical circuitry including the switches and having gaps interrupting particular circuits between the above-mentioned metal strip and the above-mentioned flat surface of conducting material except when started into activation by contact between them as a result of travel of a golf clubhead in a golf swing which causes the clubhead to strike the elastomeric feeler in its path and substantially bend it in the direction of its travel.

5. A golf stroke analyzer of claim 4 in which the thickness of the insulation is greater than the thickness of the metal strip.

6. A method for evaluating a golf stroke comprising:

(1) setting up three pairs of vertical sensors adapted to sense the physical contact of a club head as it travels in its swing without appreciable retardation thereof, the pairs being side by side in a row whose center line runs along the swing and the middle pair being equi-spaced from the two end pairs, with the individual sensors of each pair spaced apart more than the width of the ball and having a path for the ball between them, but spaced apart less than the length of the club head;

(2) providing electrical contacts closed by the movement of the sensors when physically contacted by the club head;

(3) providing an electrical setup to sense the time between contact with the first pair and contact with the second pair and the time between contact with the second pair and contact with the third pair and electrically compare the two times and light a light when the first said time is greater than the second said time; and (4) the golfer swinging a golf club in a way to provide the above-indicated travel by its head across the six sensors and thereby lighting the light if the second said time is less than the first said time, thereby enabling the golfer to evaluate whether he is properly following through on his swing.

7. A golf stroke analyzer having pairs of activators located to be physically contacted by a golf club at three different positions of the stroke, with the intermediate position being equidistant from the first and last positions, the path of the stroke between the intermediate and last positions being beyond where contact with a ball would normally be made, whereas the path of the stroke between the first and intermediate position is at least more representative than the foregoing of the stroke at the time of contact with the ball, the two activators of each pair being located one on either side of the center of the path of the stroke of the golf clubhead, in position to physically contact that head toward the respective end thereof but with room for the path of the golf ball in between, comparator means receiving input from such activators for comparing the speed of the stroke in its path between the last two positions with the speed of the stroke in its path including at least one earlier position, and means governed by the comparator means, for indicating whether the average speed of the golf club between the intermediate and last position is greater than that in the path of the stroke between the first and intermediate position.

* * * * *